US011573060B2

(12) United States Patent
Shreve

(10) Patent No.: US 11,573,060 B2
(45) Date of Patent: Feb. 7, 2023

(54) MAGAZINE EXTENSION

(71) Applicant: C Products Defense, Inc., Bradenton, FL (US)

(72) Inventor: Bernie Shreve, Lakewood Ranch, FL (US)

(73) Assignee: C PRODUCTS DEFENSE, INC., Bradenton, FL (US)

( * ) Notice: Subject to any disclaimer, the term of this patent is extended or adjusted under 35 U.S.C. 154(b) by 0 days.

(21) Appl. No.: 17/151,628

(22) Filed: Jan. 18, 2021

(65) Prior Publication Data

US 2021/0247156 A1 Aug. 12, 2021

Related U.S. Application Data

(60) Provisional application No. 62/971,429, filed on Feb. 7, 2020.

(51) Int. Cl.
*F41A 9/71* (2006.01)

(52) U.S. Cl.
CPC ..... *F41A 9/71* (2013.01)

(58) Field of Classification Search
CPC ..... F41A 9/71; F41A 9/65; F41A 9/63
USPC ..... 42/50, 7, 49.02, 49.01
See application file for complete search history.

(56) References Cited

U.S. PATENT DOCUMENTS 4,862,619 A * 9/1989 Baldus ..... F41A 9/71 42/7
5,584,136 A * 12/1996 Boland ..... F41A 9/71 42/50
5,666,752 A * 9/1997 Grams ..... F41A 9/71 42/49.02
6,557,287 B2 * 5/2003 Wollmann ..... F41A 9/65 42/50
7,117,622 B2 * 10/2006 Freed ..... F41A 9/65 42/71.02
10,048,030 B2 * 8/2018 Corso ..... F41A 9/65
10,190,835 B2 * 1/2019 Hsu ..... F41A 9/71
10,852,086 B1 * 12/2020 Hillis ..... F41A 9/71
10,996,010 B2 * 5/2021 Cass ..... F41A 9/65
11,085,717 B1 * 8/2021 Hillis ..... F41A 9/71
11,168,954 B1 * 11/2021 Spykerman ..... F41A 9/71
(Continued)

FOREIGN PATENT DOCUMENTS

AU 2020233646 A1 * 10/2020 ..... F41A 9/65
BR 202020002405 U2 * 8/2021

*Primary Examiner* — Jonathan C Weber
(74) *Attorney, Agent, or Firm* — Bennett K. Langlotz; Langlotz Patent & Trademark Works, LLC

(57) ABSTRACT

Magazine extensions have an extension body having a floor panel, a right side wall, and an opposed left side wall, and a front wall, the right and left side walls each including linear engagement facilities each configured to engage the floor plate attachment facility, the extension body defining a chamber between the right and left side walls and rear of the front wall, and open in an upward direction, the linear engagement facilities being operable to constrain movement of the extension body between an attached condition in which the chamber is registered with the internal passage, and a detached condition, a door slidably and removably connected to the extension body and having an upper door edge, the door movable between an attached condition in which the door spans between front or rear portions of the right and left side walls, and a detached condition.

18 Claims, 4 Drawing Sheets

(56) References Cited

U.S. PATENT DOCUMENTS

| | | | | |
|---|---|---|---|---|
| 2002/0029506 | A1* | 3/2002 | Wollmann | F41A 9/65<br>42/50 |
| 2005/0011097 | A1* | 1/2005 | Freed | F41A 9/65<br>42/49.02 |
| 2017/0321979 | A1* | 11/2017 | Szczepkowski | F41A 9/71 |
| 2018/0031342 | A1* | 2/2018 | Faifer | F41A 9/71 |
| 2018/0051948 | A1* | 2/2018 | Corso | F41A 9/65 |
| 2018/0347929 | A1* | 12/2018 | Hsu | F41A 9/71 |
| 2020/0103189 | A1* | 4/2020 | Cass | F41A 9/65 |
| 2020/0208929 | A1* | 7/2020 | Corso | F41A 9/71 |
| 2020/0348094 | A1* | 11/2020 | Lee | F41A 9/71 |
| 2020/0348095 | A1* | 11/2020 | Lee | F41A 9/71 |
| 2021/0302115 | A1* | 9/2021 | Cass | F41A 9/65 |

* cited by examiner

MAGAZINE EXTENSION

CROSS-REFERENCE TO RELATED APPLICATION

This application claims the benefit of U.S. Provisional Patent Application No. 62/971,429 filed on Feb. 7, 2020, entitled "Magazine extension with rotary lock," which is hereby incorporated by reference in its entirety for all that is taught and disclosed therein.

FIELD OF THE INVENTION

The present invention relates to firearms, and more particularly to a magazine extension for a box magazine body.

BACKGROUND AND SUMMARY OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). As the firearm cycles, cartridges are moved to the top of the magazine by a follower driven by spring compression to a feed position. In most firearms, the magazine follower engages a slide-stop to hold the slide back and keep the firearm out of battery when the magazine is empty, and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition.

Increased ammunition capacity is highly desirable for a variety of firearm usage scenarios, including competitions and self-defense. Numerous magazine extensions have been developed that replace the OEM box magazine body's base plate to provide additional ammunition capacity. A variety of problems have existed with many of the designs. One example is unreliability of the connection between the magazine extension and the box magazine's body, which causes the spring, follower, and ammunition to fall out of the bottom of the box magazine's body. Another is inadequate spring tension to properly feed ammunition from the box magazine resulting from use of the OEM box magazine's spring with a magazine extension. Finally, many existing extensions require special tools to install and remove the magazine extension from the box magazine's body. Many competitive shooters prefer to disassemble, inspect, and clean their magazines in between competitions. A forgotten special tool makes this impractical, and even with the special tool, the removal and reassembly processes can be time-consuming. Most existing extensions also include extremely small set screws and pins, which are prone to being easily dropped. Some existing extensions also have the disadvantage of not being removable to enable servicing of the attached magazine.

Therefore, a need exists for a new and improved magazine extension that provides additional ammunition capacity with a reliable connection to a box magazine body and toolless removal and assembly. In this regard, the various embodiments of the present invention substantially fulfill at least some of these needs. In this respect, the magazine extension according to the present invention substantially departs from the conventional concepts and designs of the prior art, and in doing so provides an apparatus primarily developed for the purpose of providing a magazine extension that provides additional ammunition capacity with a reliable connection to a box magazine body and toolless removal and assembly.

The present invention provides an improved magazine extension, and overcomes the above-mentioned disadvantages and drawbacks of the prior art. As such, the general purpose of the present invention, which will be described subsequently in greater detail, is to provide an improved magazine extension that has all the advantages of the prior art mentioned above.

To attain this, the preferred embodiment of the present invention essentially comprises an extension body having a floor panel, a right side wall, and an opposed left side wall, and a front wall, the right and left side walls each including linear engagement facilities each configured to engage the floor plate attachment facility, the extension body defining a chamber between the right and left side walls and rear of the front wall, and open in an upward direction, the linear engagement facilities being operable to constrain movement of the extension body between an attached condition in which the chamber is registered with the internal passage, and a detached condition, a door slidably and removably connected to the extension body and having an upper door edge, the door movable between an attached condition in which the door spans between rear portions of the right and left side walls, and a detached condition, and the upper edge of the door when in the attached condition abutting a lower portion of the elongated magazine tube to prevent forward movement of the extension body from the attached condition, and enabling movement of the extension body to the detached condition when the door is removed. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
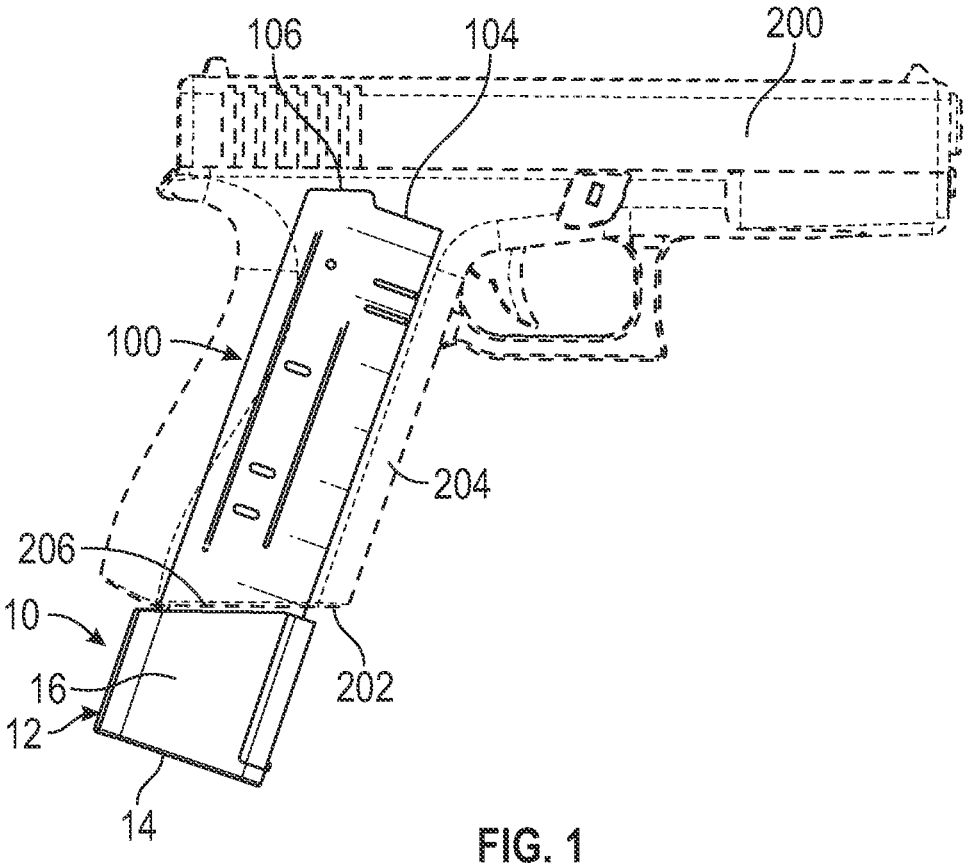
FIG. 1 is a right-side view of the current embodiment of the magazine extension constructed in accordance with the principles of the present invention shown in use attached to a box magazine body and installed in a pistol.

An embodiment of the magazine of the present invention is shown and generally designated by the reference numeral 10.

Figure 2:
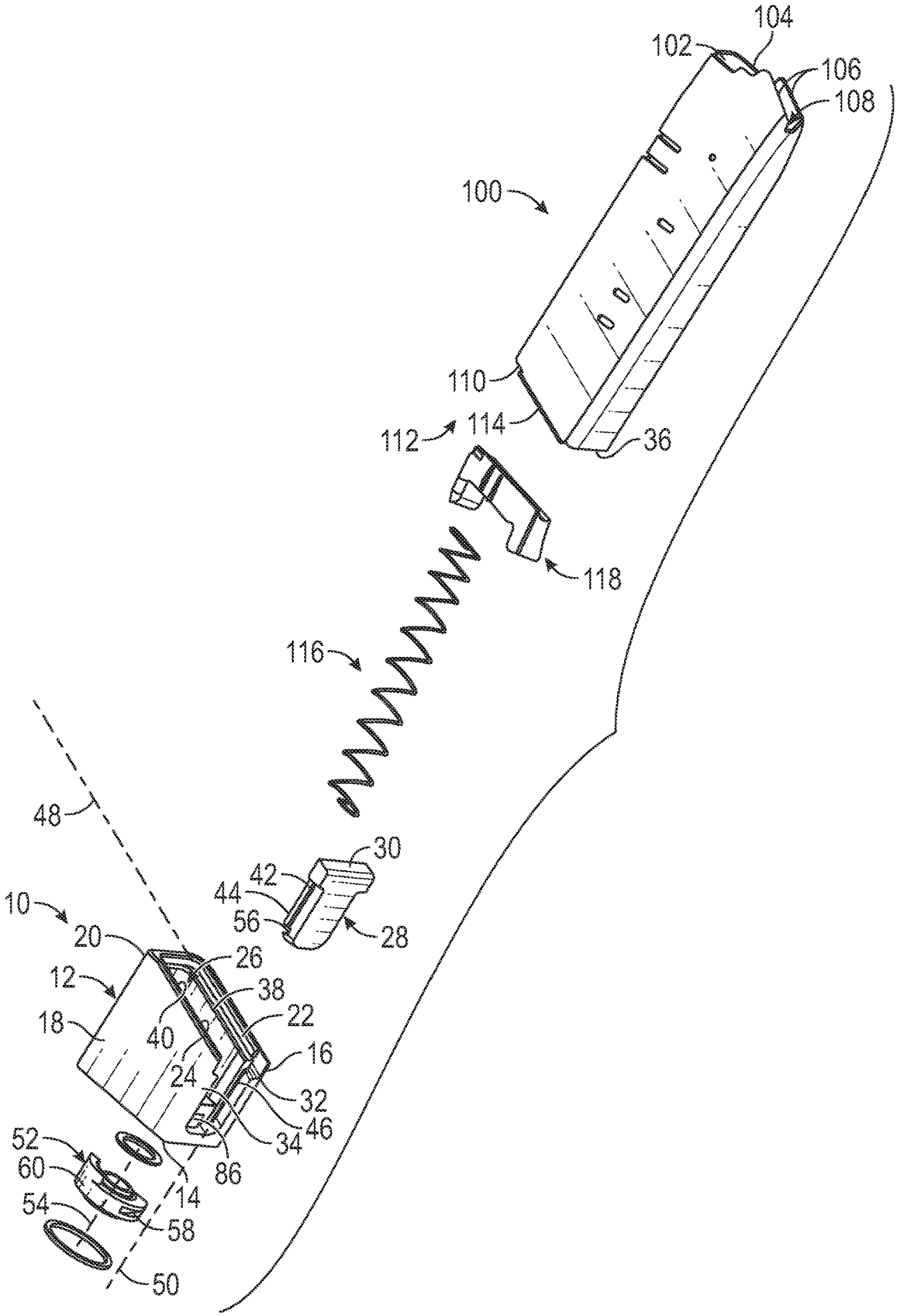
FIG. 2 is an exploded view of the magazine extension of FIG. 1.
Figure 3:
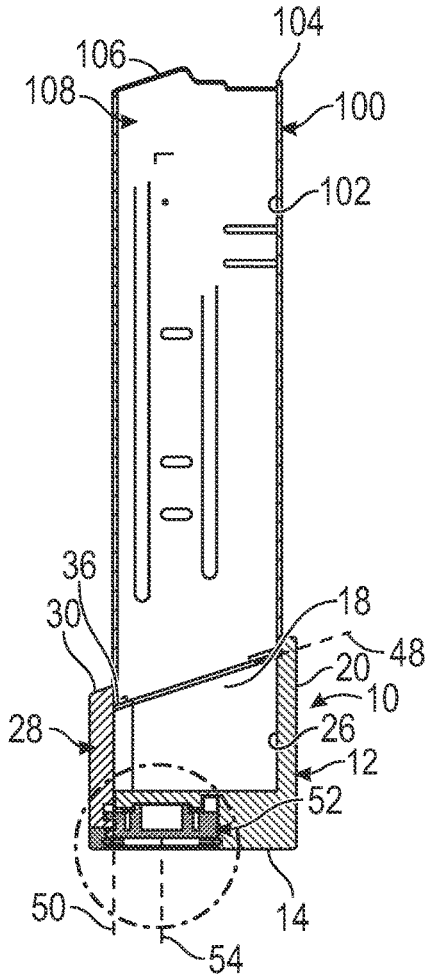
FIG. 3 is a side section view of the magazine extension of FIG. 1 with the locking cam in the unlocked position and the rear door just above the insertion point into the magazine extension body.
Figure 4:
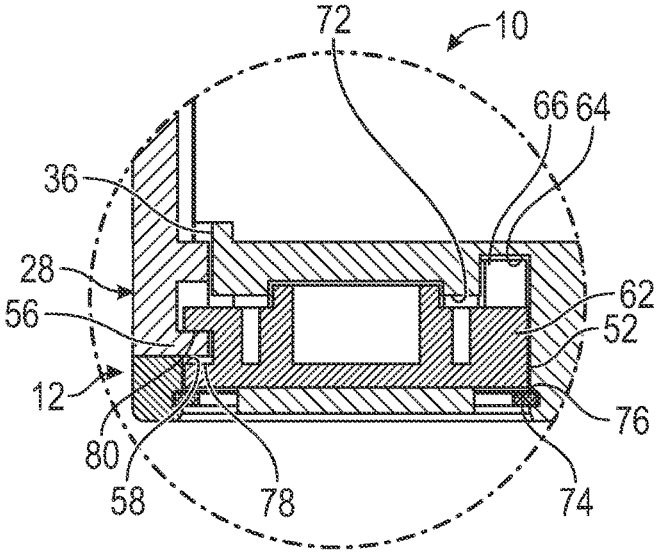
FIG. 4 is a sectional view of the magazine extension of FIG. 1.
Figure 5:
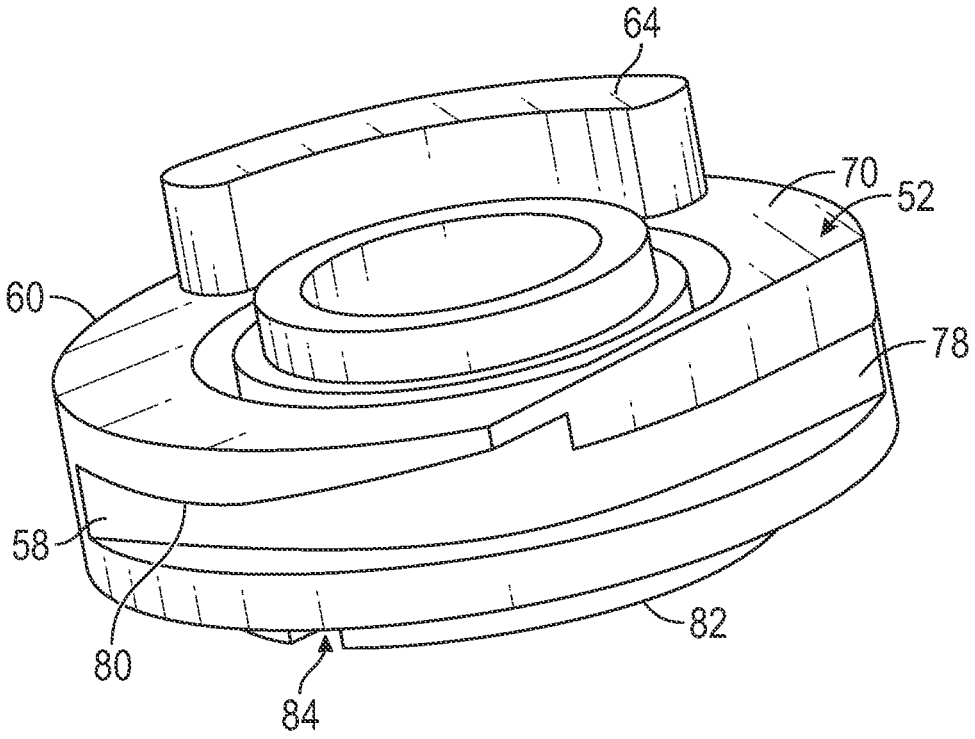
FIG. 5 is a bottom isometric view of the locking cam of FIG. 2.

FIGS. 1-5 illustrate the improved magazine extension 10 of the present invention. More particularly, the magazine extension 10 is suitable for use with an elongated magazine tube 100 defining an internal passage 102 having an upper end 104 with feed lips 106 defining an ammunition exit aperture 108 and a lower end 110 having a floor plate attachment facility 112. The internal passage receives a spring 116 and a follower 118. The spring biases the follower upwards towards the upper end of the internal passage. It should be appreciated that the spring may be longer than the spring originally supplied with the elongated magazine tube to accommodate the additional length added to the internal passage by the chamber 26 of the magazine extension. However, the original follower and still be used with the magazine extension. The floor plate (not shown) originally supplied with the elongated magazine tube is removed prior to installation of the magazine extension, which replaces the floor plate. The magazine extension has an extension body 12 having a floor panel 14, a right-side wall 16, an opposed left side wall 18, and a front wall 20. The right and left side walls each include linear engagement facilities (right linear engagement facility 22 and left linear engagement facility 24), each configured to engage the floor plate attachment facility. The extension body defines the chamber between the right and left side walls and rear of the front wall that is open in an upward direction. The linear engagement facilities are operable to constrain movement of the extension body between an attached condition in which the chamber is registered with the internal passage and a detached condition. A door 28 is slidably and removably connected to the extension body and has an upper door edge 30. The door is movable between an attached condition in which the door spans between front portions (right front portion 32 and left front portion 34) of the right and left side walls and a detached condition. The upper edge of the door when in the attached condition abuts a lower portion 36 of the elongated magazine tube prevent forward movement of the extension body from the attached condition, and enabling movement of the extension body to the detached condition when the door is removed.

The floor plate attachment facility 112 includes opposed flanges (left flange 114 is visible in FIG. 2), and the right and left linear engagement facilities 22, 24 are right and left grooves 38, 40 configured to closely and slidably receive the opposed flanges in the current embodiment. The door 28 is slidably connected to the extension body 12 by a linear attachment element 42. In the current embodiment, the linear attachment element functions as part of a flange 44 and groove 46 facility to slidably connect the door to the extension body. The linear engagement facilities define a first axis of motion 48, and the door defines a second axis of motion 50 angularly offset from the first axis of motion.

The magazine extension 10 includes a lock element 52 on the extension body 12 having a locked condition and an unlocked condition. The lock element is operable to engage the door 28 to prevent removal of the door when in the locked condition and to enable removal of the door when in the unlocked condition. In the current embodiment, the lock element is rotatably connected to the extension body and rotates on a vertical axis 54. The door defines a ledge 56, and the lock has a movable element 58 configured to engage the ledge when in the locked condition. In the current embodiment, the lock element is a planar body with a circular periphery 60. The lock element is received within a circular aperture 62 defined by the floor panel 14 of the extension body. The lock element has a top protrusion 64 that is closely received by a semicircular channel 66 in communication with the circular aperture. The semicircular channel constrains the rotational movement of the lock element to 90° by obstructing the movement of the top protrusion. A wave ring washer 68 rests between the top 70 of the lock element and the top 72 of the circular aperture. The intent of the wave ring washer is to apply tension against the cam and body and take up tolerance. A retaining ring 74 is received by a groove 76 in communication with the circular aperture to retain the lock element within the circular aperture. The movable element is a slot 78 that includes a cam surface 80. The cam surface interacts with the ledge on the door to pull the door downward as the lock element transitions from the unlocked condition to the locked condition. The lock element includes a bottom protrusion 82 that defines a coin slot 84 to facilitate the use of a coin, bladed screwdriver, or the rim of a cartridge to rotate the lock element between the unlocked and locked conditions.

The magazine extension 10 is shown in use attached to an elongated magazine tube 100 and installed in the magazine well 202 of a pistol 200. It should be appreciated that the bottom 206 of the handgrip 204 covers a sufficient portion of the front wall 20 of the extension body 12 that the extension body is not at risk of becoming detached from the elongated magazine tube even if the door 28 came loose because the lock element 52 was inadvertently left in the unlocked position.

To assemble the magazine extension 10 to the elongated magazine tube 100, the first step is to insert the follower 118 and spring 116 into the internal passage 102 through the lower end 110. The second step is to press the spring up into the internal passage far enough so that the right and left grooves 38, 40 in the extension body 12 can be aligned with the right flange 114 and left flange (not visible) on the lower end of the elongated magazine tube. The third step is to push the extension body rearward along the first axis of motion 48 until the front wall 20 abuts the elongated magazine tube while simultaneously releasing the spring to extend into the chamber 26 until the spring contacts the floor panel 14. At this point, there is sufficient frictional engagement between the left and right flanges and the right and left grooves that the extension body requires the application of substantial force forward along the first axis of motion to dislodge the extension body from the elongated magazine tube. The fourth step is to unlock the lock element 52 by rotating the lock element counterclockwise by 90°. The fifth step is to align the flanges 44 on the door with the grooves 46 in the right rear portion 32 and left rear portion 34 of the extension body and then slide the door down until the door is fully seated in the extension body. The sixth and final assembly step is to lock the door in place by rotating the lock element clockwise by 90°. In the locked position, the movable element protrudes through an aperture 86 defined by the floor panel to enable the movable element to receive the ledge 56 of the door 28 and prevent upward movement of the door.

To disassemble the magazine extension 10 from the elongated magazine tube 100, the first step is to unlock the lock element 52 by rotating the lock element counterclockwise by 90°. In the unlocked position, no portion of the lock element protrudes through the aperture 86 to obstruct upward movement of the door 28. The second step is to remove the door by pulling the door upward to disengage the flanges 44 on the door from the grooves 46 in the right front portion 32 and left front portion 34 of the extension body. The third step is to pull the extension body forward along the first axis of motion 48 to disengage the right flange 114 and left flange on the lower end of the elongated magazine tube from the right and left grooves 38, 40 in the extension body while simultaneously capturing the spring 116 to prevent uncontrolled release. The fourth and final step is to pull the spring 116 and follower 118 out of the internal passage 102 of the elongated magazine tube.

In the current embodiment, the pistol 200 is a typical pistol. The chamber 26 of the extension body 12 increases the capacity of the elongated magazine tube 100 by up to six cartridges, but the quantity of cartridges could be greater amounts with changes to the dimensions of the magazine extension 10. The extension body can be made of any suitable material, including anodized aluminum and polymer.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a magazine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the magazine of the current invention is suitable for use with rifles as well as the pistols described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ammunition magazine extension assembly for an elongated magazine tube defining an internal passage, having an upper end with feed lips defining an ammunition exit aperture, and a lower end having a floor plate attachment facility, the assembly comprising:

an extension body having a floor panel, a right side wall, and an opposed left side wall, and a front wall;

the right and left side walls each including linear engagement facilities each configured to engage the floor plate attachment facility;

the extension body defining a chamber between the right and left side walls and rear of the front wall, and open in an upward direction;

the linear engagement facilities being operable to constrain movement of the extension body between an attached condition in which the chamber is registered with the internal passage, and a detached condition;

a door slidably and removably connected to the extension body and having an upper door edge;

the door movable between an attached condition in which the door spans between rear or front portions of the right and left side walls, and a detached condition;

the upper edge of the door when in the attached condition abutting a lower portion of the elongated magazine tube to prevent forward movement of the extension body from the attached condition, and enabling movement of the extension body to the detached condition when the door is removed; and a lock element on the extension body having a locked condition and an unlocked condition and operable to engage the door to prevent removal of the door when in the locked condition and to enable removal of the door when in the unlocked condition.

2. The ammunition magazine extension assembly of claim 1 wherein the floor plate attachment facility includes opposed flanges and the linear engagement facilities are grooves configured to closely and slidably receive the opposed flanges.

3. The ammunition magazine extension assembly of claim 1 wherein the door is slidably connected to the extension body by a linear attachment element.

4. The ammunition magazine extension assembly of claim 1 wherein the door is slidably connected to the extension body by a flange and groove facility.

5. The ammunition magazine extension assembly of claim 1 wherein the linear engagement facilities define a first axis of motion, and the door defines a second axis of motion angularly offset from the first axis of motion.

6. The ammunition magazine extension assembly of claim 1 wherein the lock element is rotatably connected to the extension body.

7. The ammunition magazine extension assembly of claim 6 wherein the lock element rotates on a vertical axis.

8. The ammunition magazine extension assembly of claim 1 wherein the door defines a ledge, and the lock has a movable element configured to engage the ledge when in the locked condition.

9. The ammunition magazine extension assembly of claim 1 wherein the lock element is a planar body with a circular periphery.

10. An ammunition magazine comprising:

an elongated magazine tube defining an internal passage, having an upper end with feed lips defining an ammunition exit aperture, and a lower end having a floor plate attachment facility, an extension body having a floor panel, a right side wall, and an opposed left side wall, and a front wall;

the right and left side walls each including linear engagement facilities each configured to engage the floor plate attachment facility;

the extension body defining a chamber between the right and left side walls and rear of the front wall, and open in an upward direction;

the linear engagement facilities being operable to constrain movement of the extension body between an attached condition in which the chamber is registered with the passage, and a detached condition;

a door slidably and removably connected to the extension body and having an upper door edge;

the door movable between an attached condition in which the door spans between rear portions of the right and left side walls, and a detached condition;

the upper edge of the door when in the attached condition abutting a lower portion of the magazine tube to prevent forward movement of the extension body from the attached condition, and enabling movement of the extension body to the detached condition when the door is removed, and a lock element on the extension body having a locked condition and an unlocked condition and operable to engage the door to prevent removal of the door when in the locked condition and to enable removal of the door when in an unlocked condition.

11. The ammunition magazine of claim 10 wherein the floor plate attachment facility includes opposed flanges and the engagement facilities are grooves configured to closely and slidably receive the opposed flanges.

12. The ammunition magazine of claim 10 wherein the door is slidably connected to the extension body by a linear attachment element.

13. The ammunition magazine of claim 10 wherein the door is slidably connected to the extension body by a flange and groove facility.

14. The ammunition magazine of claim 10 wherein the linear engagement facilities define a first axis of motion, and the door defines a second axis of motion angularly offset from the first axis.

15. The ammunition magazine of claim 10 wherein the lock element is rotatably connected to the extension body.

16. The ammunition magazine of claim 15 wherein the lock element rotates on a vertical axis.

17. The ammunition magazine of claim 10 wherein the door defines a ledge, and the lock has a movable element configured to engage the ledge when in the locked condition.

18. The ammunition magazine of claim 10 wherein the lock element is a planar body with a circular periphery.

* * * * *